United States Patent [19]

Dupuy

[11] 3,942,541

[45] Mar. 9, 1976

[54] DEVICE ENABLING THE CONVEYING, ONE BY ONE, OF COINS INSERTED IN BULK IN A RECEPTACLE

[75] Inventor: Marcel Dupuy, Issey-les-Moulineaux, France

[73] Assignee: Compagnie Generale d'Automatisme, France

[22] Filed: Sept. 18, 1974

[21] Appl. No.: 507,205

[30] Foreign Application Priority Data

Sept. 18, 1973 France ..... 73.33430

[52] U.S. Cl. ..... 133/1 R; 198/287

[51] Int. Cl.[2] ..... G07D 9/00

[58] Field of Search ..... 133/8 R, 8 E, 3 E, 3 F, 133/1 R; 221/162; 198/195, 198, 199, 287, 154

[56] References Cited

UNITED STATES PATENTS

| | | | |
|---|---|---|---|
| 2,609,912 | 9/1952 | Engel | 198/287 |
| 2,745,537 | 5/1956 | Cadman | 198/287 |
| 3,070,210 | 12/1962 | Woodward, Jr. | 198/287 |
| 3,288,153 | 11/1966 | Ballard et al. | 133/8 R |
| 3,347,249 | 10/1967 | Becker | 133/8 R |
| 3,396,737 | 8/1968 | Picollo | 133/8 R X |
| 3,603,327 | 9/1971 | Buchholz | 133/8 R |

*Primary Examiner*—Allen N. Knowles
*Attorney, Agent, or Firm*—Craig & Antonelli

[57] ABSTRACT

Device for conveying coins inserted in bulk in a receptacle one by one, characterized in that it comprises a hopper having the shape of a truncated pyramid pointing upwards and at the bottom of which is situated a roller which enables the passing, one by one, of the coins inserted in the hopper. The roller is rotating in an opposite direction to the natural falling descent of the coins, and a second roller is arranged with an axis perpendicular to the lower face of the hopper and also rotating in an opposite direction to the natural fall of the coins.

4 Claims, 4 Drawing Figures

Figure 1:
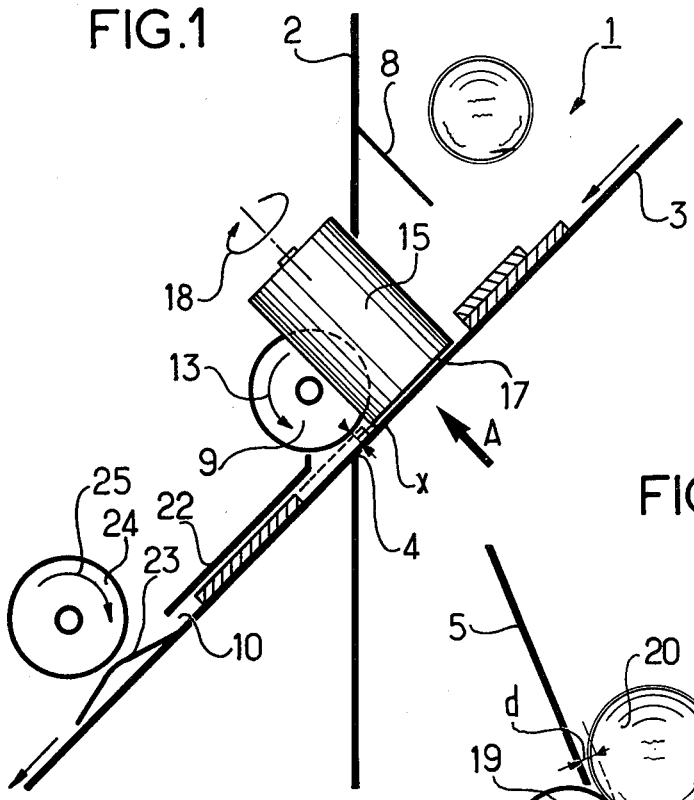

DEVICE ENABLING THE CONVEYING, ONE BY ONE, OF COINS INSERTED IN BULK IN A RECEPTACLE

The present invention concerns a device for the automatic cashing of coins, comprising a set of mechanisms enabling a suitable conveying of coins towards a sensor sensing the physical properties of the coins which distinguishes their various values, then a previous storing of the coins enabling a visual inspection before a final storage.

More particularly, the invention has for its object a device enabling the conveying, one by one, successively, of the coins of money deposited in bulk in a basket, characterized in that at least the lower portion of the basket is a hopper substantially in the form of a truncated pyramid tapering towards the top and comprising a first substantially vertical face, a second oblique face forming, with the first face, a first dihedral having a horizontal ridge and an angle of a value less than 90°, a third face and a fourth face which are lateral to the first and second faces, constituting a second dihedral having a ridge substantially perpendicular to the said first face; in that the bottom of the said hopper extends by a passage having parallel lateral edges extending the said third and fourth faces from the place where the width of the bottom of the hopper is greater than the largest diameter of the coins used but less than twice the diameter of the smallest coins used, the bottom of that passage being constituted by the extension of the said second face of the hopper; in that a first roller having an axis parallel to the ridge of the said first dihedral is placed at least partly inside the hopper at the place where the connection is made between the latter and the said passage and in such a way that its nearest generatrix to the second face be distant from the latter by a value greater than the thickness of the thickest coin used but smaller than twice the thickness of the thinnest coin used, the said roller being driven in a rotating movement in the opposite direction to the natural movement of the coins under the effect of gravity; and in that a second roller, having an axis perpendicular to the said second face of the hopper and situated outside it, enters partly inside the hopper due to a through window formed in the third face of the hopper, the base of the roller facing the said second face of the hopper being at a distance from that second face less than the thickness of the thinnest coin used and that roller being driven in a rotating movement in the direction which is opposite to the natural movement of the coins under the action effect of gravity.

According to another characteristic of the invention, the said passage has an upper face limiting a height of passage very slightly greater than the distance separating the said second face of the hopper from the generatrix of the first roller which is the nearest to that second face but less than twice the thickness of the coin used, that passage conveys the coins under the action of their weight, from the bottom of the hopper up to a third roller having a horizontal axis co-operating with a resilient support part placed on the bottom of the said passage and below the said third roller and separated from the latter by a distance slightly less than the thickness of the thinnest coin used, the roller being driven in a rotating movement in the direction corresponding to the swallowing of the coins which are thus cast out at the back of the said third roller with a constant original speed.

With reference to the diagrammatic figures herewith, an example of the implementing of the invention having no limiting character, will be described.

FIG. 1 gives a diagrammatic representation of the invention according to a plane perpendicular to the axis of the first roller.

Figure 2:
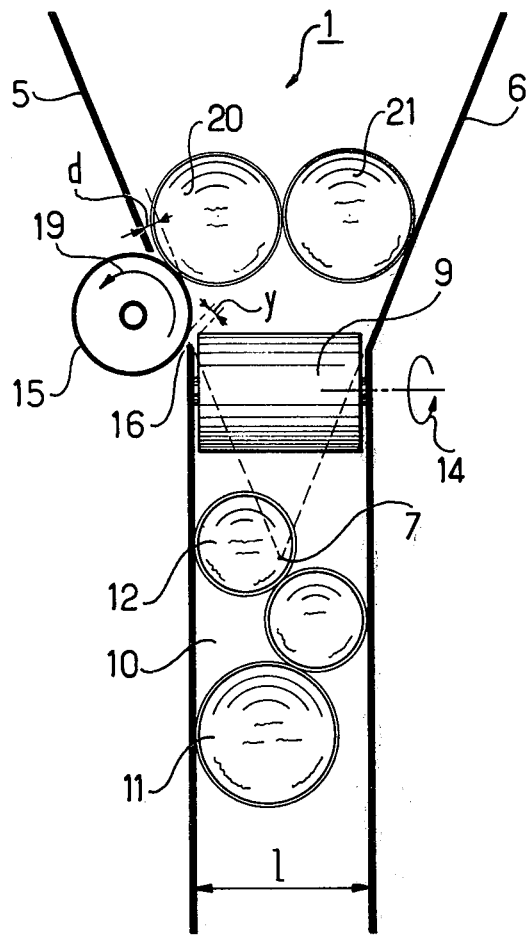

FIG. 2 is a view in the direction of the arrow A in FIG. 1, assuming that the faces of the hopper are transparent.

Figure 3:
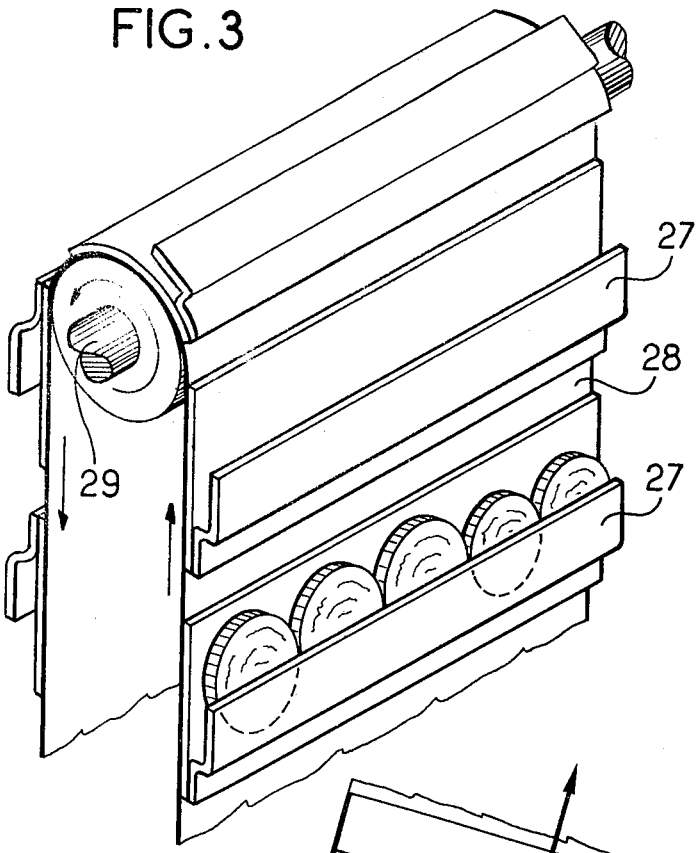
Figure 4:
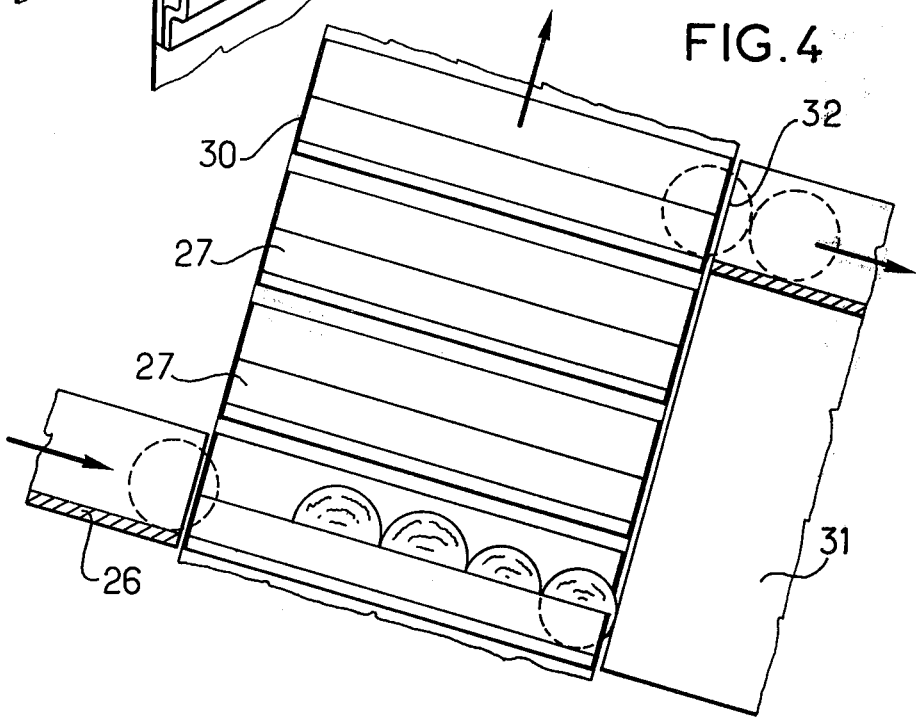

FIGS. 3 and 4 give a diagrammatic representation of an intermediate stocking device making it possible to inspect the coins situated in the hopper which have reached the end of the cycle visually.

In the example described, the invention is applied to a device for the automatic cashing of coins, paid, for example, by the user of a toll road, but, of course, the invention may have any other application. In that application, the system comprises a device for conveying the coins paid in a file, according to the invention, followed by an ejection roller device, according to the invention, the coins then falling in a sensor sensing physical properties distinguishing the values of the coins paid, the coins subsequently being conveyed towards an intermediate storing device according to the invention then stored finally in a chest.

On referring to FIGS. 1 and 2, a hopper 1 comprising a first vertical wall 2, a second oblique wall 3 forming, with the wall 2, a dihedral whose ridge 4 is horizontal, a third lateral wall 5 and a fourth wall 6 forming a dihedral whose ridge 7 is perpendicular to the vertical wall 2, may be seen. The oblique wall 3 which is the lower wall is preferably drilled with many little holes enabling rain water to drain out. Likewise, the vertical wall 2 comprises a small cowl 8 extending from one lateral wall 5 to the other lateral wall 6.

A first roller 9 having a horizontal axis parallel to the ridge 4 is placed at the bottom of the hopper 1 at the place where the latter extends in the form of a passage 10 whose width l is greater than the diameter of the largest coin used 11 but less than twice the diameter of the smallest coin used 12, so that two coins never pass together under the roller 9 and so that they remain in a line one behind another in the passage 10. The roller 9 rotates in the direction shown by the arrows 13 and 14 (respectively on FIGS. 1 and 2). Likewise, the distance $x$ between the oblique wall 3 and the generatrix or peripheral surface of the roller 9 nearest to that wall is greater than the thickness of the thickest coin used but less than twice the thickness of the thinnest coin used, so that one coin and only one coin may pass at a time under the said roller 9.

A second roller 15 having an axis perpendicular to the oblique wall 3 is partly situated inside the hopper 1 by means of a window 16 formed in the lateral wall 5. The penetration distance d of the roller 15 into the hopper, being, to great advantage, of the order of 3 to 4 mm and the base 17 of the roller being as close as possible to the oblique wall 3. Moreover, the distance $y$ (FIG. 2) is also, to great advantage, as short as possible. The roller 15 rotates in the direction shown by the arrows 18 and 19 (respectively FIGS. 1 and 2) corresponding to the reverse of the natural movement of the coins under the effect of their weight. This roller 15 is intended to prevent two coins from remaining balanced against each other and against the walls 5 and 6. It is placed in such a way that at least one of the coins possibly balanced against another coin (20 and 21, FIG. 2) rest, not against the wall 5, but against the roller 15 which, driven in a rotating movement in the reverse direction to the movement of the coins, disturbs their balance. The direction of rotation of the rollers 9 and 15 is important and makes it possible to avoid any cramming and blocking, and foreign bodies having a thickness greater than the distance *x* or a width greater than the distance l do not risk blocking the device and do not even hinder the normal descent of the coins, as experience has proved.

In practice, though these values have no limiting character, the angle formed by the walls 5 and 6 is in order of 45°. Similarly, the angle formed by the walls 2 and 3 is also in the order of 45°. The rollers rotate at a speed of a hundred or so revolutions per minute. The oblique wall 3 may be lowered by pivoting about an axis which has not been shown, making it possible to remove any foreign bodies.

In principle, the distant l is calculated for coins which are to be used by the device and, for example, for U.S. coins of quarters, nickles and dimes, as well as for French coins of 50 centimes and of one franc, but that distance may be calculated as well as the thickness *x* for a much greater range of coins, the important thing being above all, that the device must allow the coins to pass only one by one, for the sensor which follows can generally define the value of only one coin at a time. If the user inserts, contrary to the normal method of using, coins which are far too small, they may perhaps pass, but the sensor will not recognize them and in any case, the mechanism will not be blocked, this being the main feature.

At the output of the roller 9, the coins arrive in the passage 10 which comprises an upper wall 22 distant from the extension of the wall 3 by a little more than the distance *x* so as to avoid blocking in the case of the passing under the roller 9 of a coin having a thickness which is very close to *x*. The coins are thus conveyed towards a resilient blade 23 situated on the bottom of the passage and above which is placed a third roller 24 driven in a rotating movement in the direction of the arrow 25 which corresponds, contrary to the first two rollers, to the direction of movement of the coins. The distance separating the resilient blade from the roller 24 is slightly less than the thickness of the thinnest coin used, thus ensuring in all cases, the contact of the coins with the roller 24. The aim of that roller is to enable the separating of the coins by the acceleration of the gravity by imparting to them a well-defined dropping speed. The coins thus drop separately towards a sensor sensing the physical properties of the coins, this sensor being of a well-known type such as, for example a sensor measuring the magnetic mass and the diameter of the coins, for example, a sensor known under the trade name N.R.I.

By way of a non-limiting example, it is possible to have a roller with a diameter of 46 mm rotating at 43.2 revolutions per minute imparting to the coins an initial speed of 105 mm/s, this causing a spacing of 200 milliseconds at the drop on the sensor for Italian coins of 50 lires and sightly greater for coins of 200 lires. The said three rollers are, to great advantage, made of natural or synthetic rubber.

The device may comprise, moreover, at the output of the sensor, an intermediate storing device; the latter device is shown in FIGS. 3 and 4 in a perspective view and a front view. The coins leaving, for example, the sensor by a passage 26 which conveys them into the receptacles in the shape of narrow troughs 27 having sides which are vertical and inclined with respect to the horizontal. These troughs are fixed on a conveyor belt 28 stretched between two spindles only one of which 29 has been shown, the one of them being a drive spindle and moving the conveyor belt step by step so that at each advance upwards, the following trough will place itself in the alignment of the passage 26. After a certain number of movements, the coins reach the top of the trough 30. In the preceding troughs, the coins abut against a plate 31 but when they reach the top, they flow out through the opening 32 to be stocked finally for example in a safe. That device makes it possible to check visually through a transparent wall the coins inserted in the basket by a user. When each user leaves, the conveyor belt moves up one space.

A control device may be installed in such a way that the advancing of the conveyor belt upwards will correspond immediately to the opening of the housing which contains the intermediate storing device, thus immediately putting all of the coins stored safely in the chest.

It must be understood that it would not be going beyond the scope of the invention to modify certain secondary aspects of the invention or to replace certain elements by other equivalent elements fulfilling the same function.

What I claim:

1. Device enabling the conveying, one by one, of the coins deposited in bulk in a basket, characterized in that at least the lower portion of the said basket is a hopper substantially in the form of a truncated pyramid tapering towards the top and comprising a first substantially vertical face (2) a second oblique face (3) forming, with the first face, a first dihedral (4) having a horizonal ridge and a value less than 90°, a third face (5) and a fourth face (6) which are lateral, constituting a second dihedral (7) having a ridge substantially perpendicular to the said first face, in that the bottom of the said hopper extends by a passage (10) having parallel lateral edges extending the said third and fourth faces from the place where the width of the bottom of the hopper is greater than the largest diameter of the parts used but less than twice the diameter of the smallest coins used, the bottom of that passage being constituted by the extension of the said second face of the hopper, in that a first roller (9) having an axis parallel to the ridge of the said first dihedral is placed at least partly inside the hopper at the place where the connection is made between the latter and the said passage and in such a way that its nearest generatrix to the second face be distant from the latter by a value greater than the thickness of the thickest coin used but smaller than twice the thickness of the thinnest coin used, the said roller (9) being driven in a rotating movement in the opposite direction to the natural movement of the coins under the effect of gravity and in that a second roller (15), having an axis perpendicular to the said second face of the hopper and situated outside it, enters partly inside the hooper due to a through window (16) formed in the third face (5) of the hopper, the base of the roller facing the said second face of the hopper being at a distance from that second face less than the thickness of the thinnest coin used and that roller being driven in a rotating movement in the direction which is opposite to the natural movement of the coins under the effect of gravity.

2. Device according to claim 1, characterized in that the said passage has an upper face (22) limiting a height of passage very slightly greater than the distance separating the said second face of the hopper from the generatrix of the first roller which is the nearest to that second face but less than twice the thickness of the part used, that passage conveys the coins under the action of their weight, from the bottom of the hopper up to a third roller (24) having a horizontal axis co-operating with a resilient support part (23) placed on the bottom of the said passage and below the said third roller and separated from the latter by a distance slightly less than the thickness of the thinnest coin used, the roller being driven in a rotating movement in the direction corresponding to the swallowing of the coins which are thus cast out at the back of the said third roller with a constant original speed.

3. Device according to claim 1, characterized in that apertures are provided through said second face and means are provided for lowering said second face.

4. Device according to claim 2, wherein at the output of a conventional sensor located at the output of the third roller (24) there are provided several receptacles (27) in the shape of narrow troughs having vertical sides slightly inclined with respect to the horizontal and fixed to the conveyor belt (30) which may move step by step, in that the trough situated at the lower part of the front face is supplied with coins by a lateral feed passage (26), the coins abutting on the other lateral face against a lateral stop plate (31) which has an opening (32) at the level of the upper part of the conveyor belt allowing the coin situated in the said upper trough to leave.

* * * * *